United States Patent [19]

Franzen

[11] 4,164,115

[45] Aug. 14, 1979

[54] PNEUMATICALLY OPERATED YARN THREADING MECHANISMS FOR TEXTILE YARN PROCESSING MACHINES

[75] Inventor: Gustav Franzen, Willich, Fed. Rep. of Germany

[73] Assignee: Palitex Project Company, GmbH, Krefeld, Fed. Rep. of Germany

[21] Appl. No.: 926,034

[22] Filed: Jul. 19, 1978

[30] Foreign Application Priority Data

Jul. 23, 1977 [DE] Fed. Rep. of Germany ..... 2733318

[51] Int. Cl.[2] ..... D01H 7/86; D01H 15/00

[52] U.S. Cl. ..... 57/279; 57/58.7; 57/58.83

[58] Field of Search ..... 57/34 R, 34.5, 58.49, 57/58.7, 58.83, 58.86, 106, 279, 280

[56] References Cited

U.S. PATENT DOCUMENTS

| | | | |
|---|---|---|---|
| 2,715,308 | 8/1955 | Soussloff et al. | 57/58.7 X |
| 3,552,111 | 1/1971 | Treus et al. | 57/106 X |
| 3,731,478 | 5/1973 | Franzen | 57/58.7 |
| 3,975,893 | 8/1976 | Franzen | 57/34 R |

*Primary Examiner*—John Petrakes

*Attorney, Agent, or Firm*—Bell, Seltzer, Park & Gibson

[57] ABSTRACT

Improved pneumatically operated yarn threading mechanisms are provided for textile yarn processing machines, such as a two-for-one twister or the like, having spindle assemblies each including a rotor mechanism with a yarn passageway extending along the axis of the spindle assembly and radially out, a stationary carrier mechanism carrying a hollow yarn supply package and including a hollow hub portion extending through the yarn package with a yarn passageway extending along the axis of the spindle assembly and joining with the rotor mechanism yarn passageway. The threading mechanisms automatically thread yarn withdrawn from the supply package through the passageways and includes air injector nozzle positioned at the juncture of the yarn passageways for selectively creating an air suction and positive air jet through the respective yarn passageways and an air duct for selectively supplying air under pressure to the injector nozzle from an air supply connector moved into and out of connection therewith. The air duct extends from the injector nozzle substantially parallel with the carrier mechanism yarn passageway to its outer end generally at the zone of the outer end of the yarn supply package.

4 Claims, 3 Drawing Figures

T
44
63
PRESSURIZED AIR SOURCE
42
72
V
43
45
Y
68
30
40
70
29'
60'
2
66
67
65
75
P
31
60
30
10
33
29'
60'
25
26
29
53
15
52
50
11
25
28
55
56
12
14
13
32
2
17
20
32

PNEUMATICALLY OPERATED YARN THREADING MECHANISMS FOR TEXTILE YARN PROCESSING MACHINES

FIELD OF INVENTION

This invention relates to improved pneumatically operated yarn threading mechanisms for textile yarn processing machines, such as two-for-one twisters or the like.

BACKGROUND OF THE INVENTION

In textile yarn processing machines, such as two-for-one twisters, yarn is pulled from a hollow supply package carried by a stationary carrier mechanism in each of a plurality of spindle assemblies and passed through the hollow center of each yarn package by passing through a yarn passageway in the stationary carrier mechanism and a joining yarn passageway in a rotor mechanism and then radially out of the rotor mechanism for further travel through each spindle assembly in a well known manner for processing of the yarn, such as the insertion of a two-for-one twist therein.

Originally, threading of the yarn through such passageways in the carrier mechanism and the rotor mechanism of spindle assemblies of such textile yarn processing machines was accomplished manually. This manual threading operation was extremely time consuming and cumbersome and reduced the efficiency of the machine operation.

Pneumatically operated threading mechanisms have been proposed for such yarn processing machines, as disclosed in U.S. Pat. No. 3,731,478, issued May 8, 1973, and assigned to the assignee of the present invention. In the pneumatically operated threading mechanisms of this prior U.S. patent, an aspirating or ejector nozzle was provided in the rotating rotor mechanism of the spindle assembly which received air under pressure from a coupling or connecting member.

In one embodiment illustrated in the aforementioned U.S. Pat. No. 3,731,478, the coupling or connecting member, which was non-rotating, had to be coupled or connected with a non-axially positioned aperture in the bottom of the rotating rotor mechanism which required positioning of the rotor mechanism when stopped for threading-up of the spindle assembly in a predetermined position for effecting such coupling connection. Accordingly, if the rotor mechanism stopped in a position other than the predetermined position, the rotor mechanism had to be repositioned for effecting the aforesaid coupling for operating the threading mechanisms.

In another embodiment of the aforesaid U.S. Pat. No. 3,731,478, stopping of the rotor mechanism in a predetermined position for alignment with the coupling or connecting member for operating the threading mechanisms was eliminated by disposing the coupling or connecting member axially through the rotor mechanism or whorl portion thereof for alignment with an axially positioned aperture or port in the yarn storage or reserve disc of the rotor mechanism. However, even with this arrangement, coupling was required between a stationary coupling or connecting member and the rotary yarn reserve disc of the rotor mechanism which presented problems in maintenance and proper operation of the pneumatic threading mechanisms.

More recently, pneumatically operated yarn threading mechanisms have been proposed for such yarn processing machines, as disclosed in U.S. Pat. No. 3,975,893, issued Aug. 24, 1976, and assigned to the assignee of the present invention, which eliminated the above problems presented with prior pneumatically operated threading mechanisms and specifically eliminated the necessity of predetermined positioning of the rotor mechanism for the threading operation by rendering the threading mechanisms independent of the position of the spindle assembly rotor mechanism.

In the threading mechanisms in accordance with this U.S. Pat. No. 3,975,893, a selectively-operated air injector nozzle means was positioned at the juncture of the respective yarn passageways through the stationary carrier mechanism and the rotating rotor mechanism for creating an air suction through the carrier mechanism passageway and a jet of positive air flow through the rotor mechanism passageway. Means were provided for selectively supplying air under pressure to the injector nozzle means which included an air duct extending through the stationary carrier mechanism from the air injector nozzle means to an outer end and an air supply connector member mounted for placement into and out of connecting engagement with the outer end of the air duct.

The specific embodiment described and illustrated in the aforesaid U.S. Pat. No. 3,975,893 provided for the air duct means leading from the outer circumference of the bottom portion of the stationary carrier mechanism, radially through such bottom portion and then axially up through the hub portion of the stationary carrier mechanism to the air injector nozzle means. With the air duct arranged in this manner, the bottom portion of the carrier mechanism must be of a sufficient thickness to be capable of accommodating the air duct. This presented problems with respect to construction of the carrier mechanism and resulted in undue bulk in the bottom portion of such carrier mechanism.

Accordingly, it is the object of this invention to obtain the benefits and advantages of the pneumatically operated yarn threading mechanisms of assignee's prior U.S. Pat. No. 3,975,893 over previously proposed devices and methods for threading spindle assemblies of such textile yarn processing machines, while overcoming the disadvantages and problems presented with the threading mechanisms of U.S. Pat. No. 3,975,893 and eliminating the necessity for having a bottom portion of the carrier mechanism in spindle assemblies for such textile yarn processing machines of a thickness sufficient to accommodate an air duct.

SUMMARY OF THE INVENTION

The above and other objects and advantages are accomplished in accordance with the present invention by providing improved pneumatically operated yarn threading mechanisms for textile yarn processing machines, generally as follows.

The improvement of this invention is provided in a textile yarn processing machine, such as a two-for-one twister or the like, having a plurality of spindle assemblies. Each spindle assembly includes a driven rotor mechanism defining therewithin an elongate yarn passageway extending initially along the axis of the spindle assembly and then radially out of the rotor mechanism. A stationary carrier mechanism is provided for carrying a hollow supply package of yarn and includes a hollow hub portion extending through the hollow yarn supply package to the outer end thereof and defines therewithin an elongate yarn passageway extending along the axis of the spindle assembly and joining with the rotor mechanism yarn passageway.

Pneumatically operated threading mechanisms are provided for automatically threading yarn withdrawn from the supply package through the yarn passageways during threading-up of the spindle assembly. The threading mechanisms include selectively-operated air injector nozzle means positioned at the juncture of the yarn passageway for creating an air suction through the carrier mechanism passageway and a jet of positive air flow through the rotor mechanism passageway. Means are provided for selectively supplying air under pressure to the injector nozzle means including an air duct extending through the stationary carrier mechanism from the air injector nozzle means to an outer end and an air supply connector member mounted for placement into and out of connecting engagement with the outer end of the air duct.

The improvement of this invention comprises positioning of the air duct to extend from the injector nozzle means substantially parallel with the carrier mechanism yarn passageway through the hub portion of the carrier mechanism to its outer end which is located generally at the zone of the outer end of the yarn supply package.

Preferably, the carrier mechanism includes a hollow yarn inlet tube connected to the outer end of the hollow hub portion and which joins the yarn passageway therethrough and the hollow hub portion forms a shoulder at the outer end thereof around the inlet tube. With this arrangement, the outer end of the air duct is preferably located in the shoulder portion of the outer end of the hub portion of the carrier mechanism.

Preferably, the outer end of the air duct comprises a portion of the air duct disposed at an oblique angle to the axis of the spindle assembly and to the remaining portion of the air duct for easy placement of the air supply connector member into and out of the outer end.

BRIEF DESCRIPTION OF THE DRAWINGS

Some of the objects, advantages and a brief summary of the invention having been given, other objects, advantages and a more detailed description of the invention will be given below in conjunction with the following drawings, in which.

DESCRIPTION OF PREFERRED EMBODIMENT

While the drawings and specific description to follow will be related to a two-for-one twister textile yarn processing machine, which is the preferred textile yarn processing machine utilizing the improved mechanisms of this invention, it is to be understood that these improvements could also be utilized on other textile yarn processing machines desiring similar results.

Figures 1, 3:
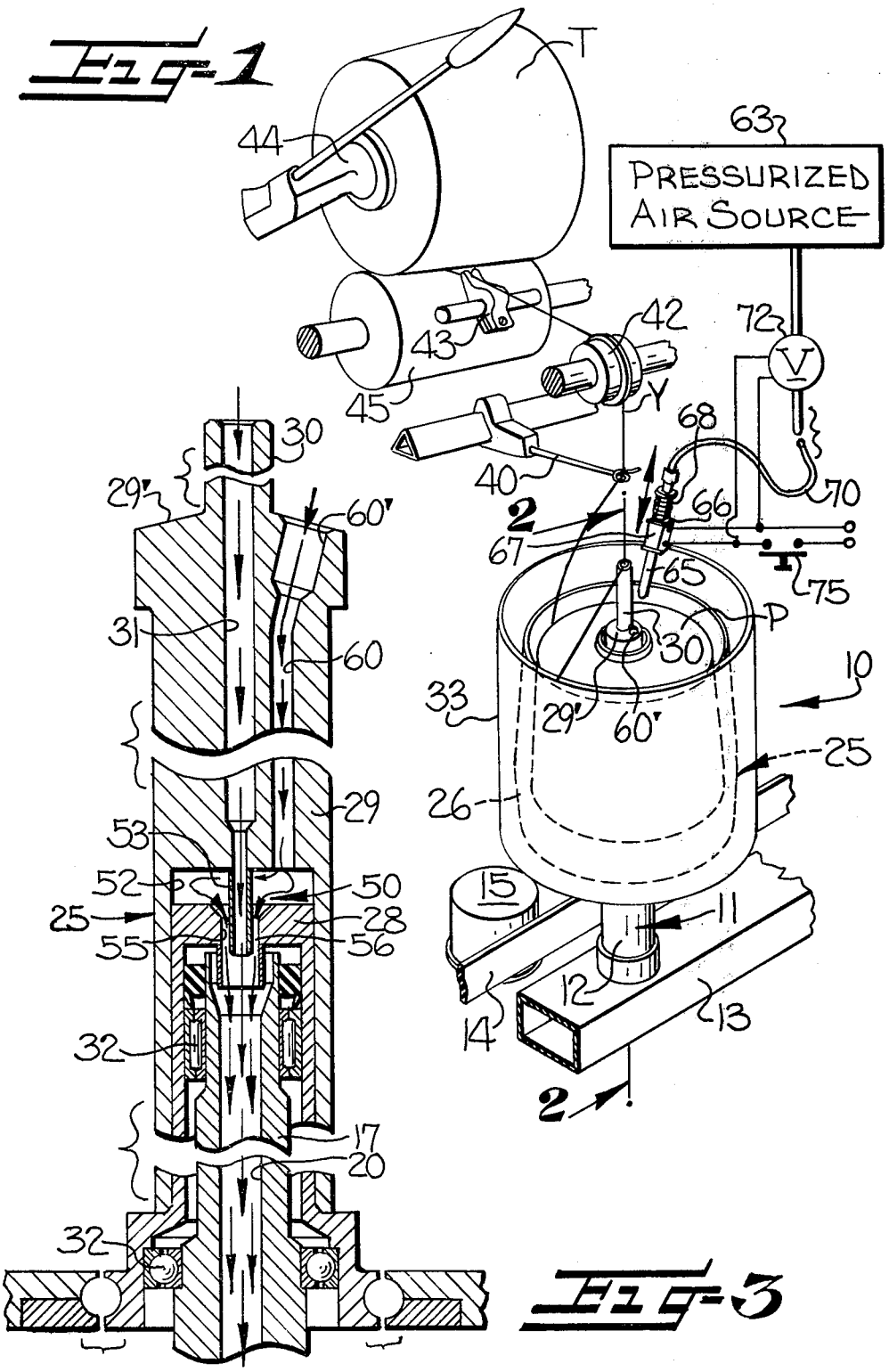
FIG. 1 is a somewhat schematic, perspective view of one spindle assembly station of a two-for-one twister textile yarn processing machine utilizing the improved pneumatically operated yarn threading mechanisms of this invention.
FIG. 3 is an enlarged, partial, elevational, cross-sectional view illustrating the yarn passageways through the carrier mechanism and rotor mechanism of the spindle assembly of FIGS. 1 and 2 and illustrating the air injection nozzle means and the air duct means for supplying air under pressure to such injector nozzle means of the pneumatic yarn threading mechanism of this invention.

Referring now to the drawings, there is illustrated in FIG. 1, a schematic, perspective view of a single spindle assembly station, generally indicated at 10, of a two-for-one twister textile yarn processing machine. It is to be understood that a plurality of these spindle assembly stations 10 are provided in side-by-side relationship in two rows along the outside of the machine. A full illustration and description of the entire two-for-one twister textile yarn processing machine is not given herein and is not believed to be necessary for an understanding of the present invention, the operation and complete structure of such a two-for-one twister being well understood by those with ordinary skill in the art.

Each of the spindle assembly stations 10 comprises a rotatably driven rotor mechanism, generally indicated at 11, which includes a whorl portion 12 suitably rotatably mounted on a portion of the twister frame 13 and rotated by a continuous, tangential drive belt 14 in a manner well understood by those with ordinary skill in the art. Tension rolls 15 are associated with each spindle assembly station 10 and are pivotally mounted for engaging and holding the drive belt 14 in tight driving engagement with the whorl portion 12 for normal rotation of the rotor mechanism 11 of the spindle assembly 10. The tension rolls 15 are conventionally movable to a second position to relieve the tight driving engagement between the drive belt 14 and the whorl 12 for stopping of the rotor mechanism 11 of the spindle assembly 10 when desired.

The rotor mechanism 11 further includes a horizontally extending yarn reserve disc device 16 secured to the whorl 12 for rotation therewith and a generally vertically extending hollow axle device 17 which also rotates with the reserve disc 16. The reserve disc 16 and hollow axle device 17 define therewithin a generally L-shaped yarn passageway 20 extending generally vertically through the hollow axle device 17 and a portion of the yarn reserve disc 16 and generally horizontally and radially out of the yarn reserve disc 16, as clearly shown in FIG. 2.

The spindle assembly station 10 further includes a stationary carrier mechanism, generally indicated at 25, for supporting and carrying a hollow package P of yarn Y and being rotatably mounted on the rotor mechanism 11 so that the rotor mechanism 11 may rotate relative thereto. The carrier mechanism 25 comprises a basket device 26 which surrounds the package P of yarn Y, a circular bottom portion 27 for supporting the hollow yarn package P and a hollow hub portion 28 which extends into the hollow yarn supply package P for stabilizing the yarn supply package. The hollow hub portion 28 includes a hollow yarn package carrier member 29 in partial telescoping relationship therein which also carries a hollow yarn entry tube 30 at the upper end thereof.

Figure 2:
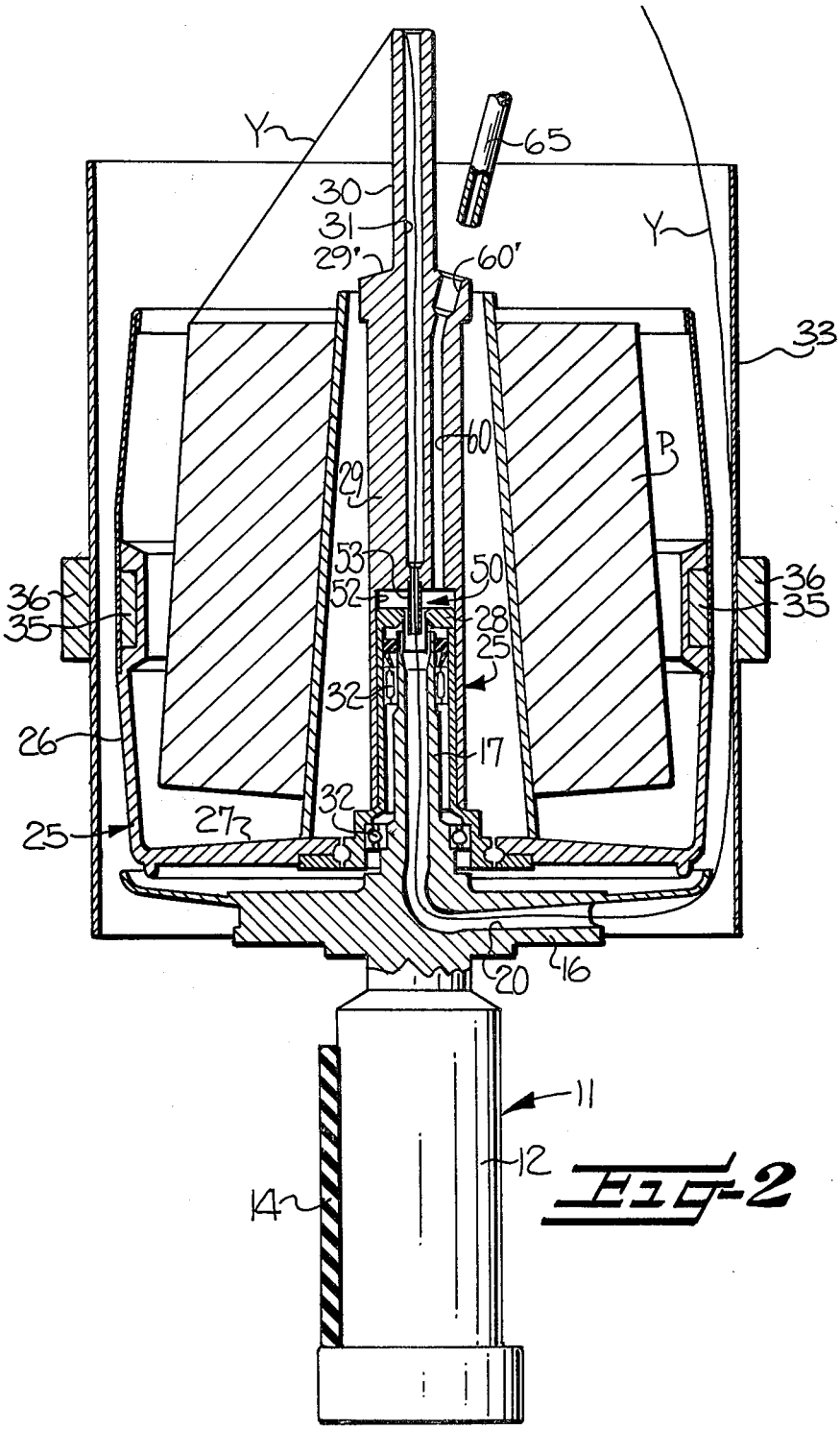
FIg. 2 is an enlarged, elevational, cross-sectional view, taken generally along the line 2—2 of FIG. 1.

As may be seen in FIGS. 2 and 3, the hollow axle device 17 of the rotor mechanism 11 extends into the hollow hub portion 28 of the carrier mechanism 25 and the carrier mechanism 25 is rotatably mounted on the rotor mechanism 11 by means of sets of bearings 32, so that the rotor mechanism 11 may rotate relative to the stationary carrier mechanism 25 which is held stationary by means to be described below.

The carrier mechanism 25, including the carrier member 29, the yarn entry tube 30 and the hollow interior of the hub portion 28 define a generally vertically extending yarn passageway 31 which is disposed in axial alignment with the yarn passageway 20 through the rotor mechanism 11 and joins with the yarn passageway 20 for providing continuous yarn passageways 31, 20 through the carrier mechanism 25 and the rotor mechanism 11.

The spindle assembly station 10 further includes a stationary balloon limitor device 33 surrounding the basket device 26 of the carrier mechanism 25. In order to maintain the yarn package carrier mechanism 25 stationary during rotation of the rotor mechanism 11, there are provided magnets 35 carried by the basket device 26 and cooperating with magnets 36 carried by the balloon limitor device 33 to prevent rotation of the carrier mechanism 25.

As may be seen in FIG. 1, the spindle assembly station 10 further includes a yarn guide eyelet 40 positioned above and in axial alignment with the yarn entry tube 30 and the yarn passageway 31 therethrough. There is further provided a pre-take-up roll 42, a yarn traversing mechanism 43 and a take-up or package roll forming mechanism 44 for winding a take-up package T of yarn Y after being processed by the spindle assembly station 10. The take-up package T of yarn in the take-up mechanism 44 is rotated by friction drive roll 45 in a well-known manner.

With the above-described mechanisms, the yarn Y is withdrawn from the supply package P, passes through the yarn entry tube 30 and the yarn passageway 31 thereof and through the continuation of the yarn passageway 31 through the stationary carrier mechanism 25. From the passageway 31, the yarn Y passes through the generally L-shaped passageway 20 of the rotating rotor mechanism 11 and out of the reserve disc 16. The yarn Y then passes upwardly between the basket device 26 and the balloon limitor 33 to form a rotating balloon of yarn Y as the rotor mechanism 11 is rotated. The yarn Y then passes through yarn guide eyelet 40 which limits the upper end of the rotating balloon of yarn, over pre-take-up roll 42 and is traversed by traversing mechanism 43 onto the take-up yarn package T in the take-up mechanism 44 to complete its travel through the respective spindle assembly station 10. As is well understood by those with ordinary skill in the art, a two-for-one twist is inserted in the yarn Y during the above-noted path of travel.

In accordance with the present invention, improved pneumatically operated yarn threading mechanisms are provided for automatically threading yarn Y withdrawn from the supply package P through the passageways 31, 20 of the carrier mechanism 25 and the rotor mechanism 11 during threading-up of the spindle assembly station 10 which would occur during yarn breakage or the doffing of a full take-up package T of yarn Y after exhaustion of the supply package of yarn P. These improved yarn threading mechanisms are characterized by construction which obtains the benefits and advantages of the pneumatically operated yarn threading mechanisms of assignee's above-mentioned, prior U.S. Pat. No. 3,975,893 over previously proposed devices and methods for threading spindle assemblies of such textile yarn processing machines, while overcoming the disadvantages and problems presented with the threading mechanisms of U.S. Pat. No. 3,975,893 by eliminating the necessity for having a bottom portion of the carrier mechanism in the spindle assemblies for such textile yarn processing machines of a thickness sufficient to accommodate an air duct. These improved pneumatically operated yarn threading mechanisms comprise the following.

A selectively operated, air injector nozzle, generally indicated at 50, is formed in the stationary carrier mechanism 25 and is positioned at the juncture of the yarn passageways 31, 20 for creating an air suction through the carrier mechanism passageway 31 and a jet of positive air flow through the rotor mechanism passageway 20, as indicated by the air flow arrows in FIG. 3, for pneumatically threading of yarn Y through the passageways which may be accomplished by placing the end of yarn Y withdrawn from the package P at the entry of the yarn entry tube 30 to be sucked through the passageway 31 by suction and blown out of the passageway 20 by the positive air flow therethrough.

The injector nozzle 50 comprises an annular open cavity 52 formed between the upper end of hollow hub portion 28 and the hollow interior of the yarn package carrier member 29 of the stationary carrier mechanism 25 and around the yarn passageway 31 therethrough for receiving air under pressure therein. The injector nozzle 50 further includes a tube 53 forming a part of and an extension of the yarn passageway 31 through the carrier member 29 and which extends through the cavity 52. The injector nozzle 50 is further provided with a tube socket member 55 carried by the hollow hub portion 28 of the carrier mechanism 25 and which extends into the rotor mechanism passageway 20 in partial telescoping relationship therewith. The tube socket member 55 also receives the tube 53 therein in partial telescoping relationship. The tube member 53 has a smaller cross-sectional dimension than the tube socket member 55 for defining an annular gap 56 between the telescoping portions of the tube member 53 and the tube socket member 55. The annular gap 56 communicates with the cavity 52 for receiving air under pressure from the cavity 52 around the tube member 53, through the tube socket member 55 and into the rotor mechanism yarn passageway 20 to produce the air injector effect.

The pneumatically operated yarn threading mechanisms further include means for selectively supplying air under pressure to the injector nozzle 50 which extend through stationary spindle assembly components, i.e. carrier mechanism 25, and comprise an air duct 60 leading from the cavity 52 and extending substantially parallel with the yarn passageway 31 through the carrier member 29 of the carrier mechanism 25 to an outer end located generally at the zone of the outer end of the yarn supply package P.

Preferably, the carrier member 29 of the carrier mechanism 25 forms a shoulder 29' at the outer end thereof and around the yarn entry tube 30 and the outlet of the air duct 60 terminates at the shoulder portion 29'.

The means for selectively supplying air under pressure to the injector nozzle 50 further includes a source of air under pressure, indicated schematically at 63 in FIG. 1, which may be any suitable pressurized air supply, a selectively movable connector member 65 positioned for movement into and out of connecting engagement with the outer end of the air duct 60 which terminates in the shoulder portion 29' of the carrier member 29 of the carrier mechanism 25. The connector member 65 is mounted in any suitable manner for selective movement into and out of the outer end of the air duct 60, such as being slideably carried by brackets 66, and having a spring 68 biasing the connector member 65 into its disengaged position and including an electrically operated solenoid 67 for selectively moving the connector member 65 into engagement with the air duct 60.

There is further provided a conduit 70 leading from the pressurized air source 63 to the connector member 65 and a selectively operable valve 72 positioned in the conduit 70 for being operated to allow the flow of pressurized air from the source 63 to the connector 65 and into the duct 60 when the connector 65 is engaged therewith. The valve 72 may be any suitably operated valve, such as a solenoid operated valve. As illustrated in FIG. 1, the valve 72 may be operated by a simple electrical circuit actuated by a push button switch 75 to open the valve 72 and to operate the solenoid 67 for moving the connector member 65 into the outer end of the air duct 60. Also, the connector member 65, its pressurized air source 63 and suitable mechanisms for moving the connector member 65 into and out of the air duct 60 and to open and close valve 72 may be positioned at each spindle assembly stations 10 or mounted on a carriage mechanism movable along the front of the yarn processing machine and along each of the spindle assembly stations 10 for respective positioning thereof at a spindle assembly station 10 requiring a threading-up operation.

In a preferred form of pneumatic threading mechanisms in accordance with this invention, the outer end of the air duct 60 terminating at the shoulder portion 29' of the carrier member 29 of the carrier mechanism 25 includes a portion 60' which is slightly enlarged and disposed at an oblique angle to the axis of the spindle assembly and to the remaining portion of the air duct 60 for easy placement of the air supply connector member 65 into and out of such outer end portion 60'.

In the drawings and specification there has been set forth a preferred embodiment of the invention and, although specific terms are employed, they are used in a generic and descriptive sense only and not for purposes of limitation.

What is claimed is:

1. In a textile yarn processing machine, such as a two-for-one twister or the like, having a plurality of spindle assemblies eaching including a driven rotor mechanism defining therewithin an elongate yarn passageway extending initially along the axis of said spindle assembly and then radially out of said rotor mechanism, a stationary carrier mechanism for carrying a hollow supply package of yarn and including a hollow hub portion extending through the hollow yarn supply package to the outer end thereof and defining therewithin an elongate yarn passageway extending along the axis of said spindle assembly and joining with said rotor mechanism yarn passageway, and pneumatically operated threading mechanisms for automatically threading yarn withdrawn from the supply package through said passageways during threading-up of said spindle assembly and including selectively-operated air injector nozzle means positioned at the juncture of said yarn passageways for creating an air suction through said carrier mechanism passageway and a jet of positive air flow through said rotor mechanism passageway and means for selectively supplying air under pressure to said injector nozzle means including an air duct extending through said stationary carrier mechanism from said air injector nozzle means to an outer end and an air supply connector member mounted for placement into and out of connecting engagement with said outer end of said air duct; the improvement of said air duct comprising:

an air duct extending from said injector nozzle means substantially parallel throughout its length with said yarn passageway through said carrier mechanism to said outer end located generally at the zone of the upper outer end of the yarn supply package.

2. In a textile yarn processing machine, as set forth in claim 1, in which said carrier mechanism further includes a hollow yarn inlet tube connected to the outer end of said hollow hub portion and joining said yarn passageway therethrough and said hollow hub portion forming a shoulder at the outer end thereof around said yarn inlet tube, and said outer end of said air duct being located in said shoulder of said outer end of said hub portion.

3. In a textile yarn processing machine, as set forth in claim 1, in which said outer end of said air duct comprises a portion of said air duct disposed at an oblique angle to the axis of said spindle assembly and to the remaining portion of said air duct for easy placement of said air supply connector member into and out of said outer end.

4. In a textile yarn processing machine, such as a two-for-one twister or the like, having a plurality of spindle assemblies each including a driven rotor mechanism defining therewithin an elongate yarn passageway extending initially along the axis of said spindle assembly and then radially out of said rotor mechanism, a stationary carrier mechanism for carrying a hollow supply package of yarn and including a hollow hub portion extending through the hollow yarn supply package to the outer end thereof and defining therewithin an elongate yarn passageway extending along the axis of said spindle assembly and joining with said rotor mechanism yarn passageway, and pneumatically operated threading mechanisms for automatically threading yarn withdrawn from the supply package through said passageways during threading-up of said spindle assembly and including selectively-operated air injector nozzle means positioned at the juncture of said yarn passageways for creating an air suction through said carrier mechanism passageway and a jet of positive air flow through said rotor mechanism passageway comprising an open cavity formed in said hollow hub portion of said carrier mechanism around said yarn passageway therethrough for receiving air under pressure, tube means extending in partial telescoping relationship around said carrier mechanism yarn passageway from said cavity into said rotor mechanism yarn passageway and being of larger cross-sectional dimensions than said carrier mechanism yarn passageway for defining an annular gap between the telescoping portions thereof which communicates with said cavity for receiving air under pressure from said cavity around said carrier mechanism yarn passageway and into said rotor mechanism passageway to produce the air injector effect, and means for selectively supplying air under pressure to said injector nozzle means including an air duct extending through said stationary carrier mechanism from said air injector nozzle means to an outer end and an air supply connector member mounted for placement into and out of connecting engagement with said outer end of said air duct; the improvement of said air duct comprising:

an air duct extending from said injector nozzle means substantially parallel throughout its length with said carrier mechanism yarn passageway through said hub portion of said carrier mechanism to said outer end located generally at the zone of the upper outer end of the yarn supply package.

* * * * *